US007816306B2

(12) United States Patent
Sasaki et al.

(10) Patent No.: US 7,816,306 B2
(45) Date of Patent: Oct. 19, 2010

(54) LUBRICANT COMPOSITION FOR HOT FORMING

(75) Inventors: Kenichi Sasaki, Osaka (JP); Sumio Iida, Osaka (JP); Shizuo Mori, Kanagawa (JP); Kazuo Tanaka, Kanagawa (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 1166 days.

(21) Appl. No.: 10/582,324

(22) PCT Filed: Dec. 9, 2004

(86) PCT No.: PCT/JP2004/018346

§ 371 (c)(1),
(2), (4) Date: Jun. 9, 2006

(87) PCT Pub. No.: WO2005/056740

PCT Pub. Date: Jun. 23, 2005

(65) Prior Publication Data

US 2007/0149413 A1 Jun. 28, 2007

(30) Foreign Application Priority Data

Dec. 10, 2003 (JP) ..... 2003-411534

(51) Int. Cl.
*C10M 173/02* (2006.01)
*C10M 125/20* (2006.01)
*C10M 145/08* (2006.01)

(52) U.S. Cl. ..... 508/156; 508/219; 508/165; 508/467; 526/200

(58) Field of Classification Search ..... 508/219, 508/156, 165, 467; 526/200
See application file for complete search history.

(56) References Cited

U.S. PATENT DOCUMENTS

| | | | | |
|---|---|---|---|---|
| 4,052,323 | A | 10/1977 | Feneberger et al. | |
| 4,533,481 | A * | 8/1985 | Jahnke | 508/194 |
| 5,326,809 | A * | 7/1994 | Bott et al. | 524/459 |
| 5,492,639 | A * | 2/1996 | Schneider et al. | 508/126 |
| 5,652,201 | A * | 7/1997 | Papay et al. | 508/228 |
| 6,455,476 | B1 * | 9/2002 | Imai et al. | 508/156 |

FOREIGN PATENT DOCUMENTS

| | | |
|---|---|---|
| EP | 0 357 508 | 3/1990 |
| GB | 857514 | 12/1960 |
| JP | 57-187395 | 11/1982 |
| JP | 58-047095 | 3/1983 |
| JP | 58-047097 | 3/1983 |
| JP | 58-049800 | 3/1983 |

(Continued)

*Primary Examiner*—Glenn Caldarola
*Assistant Examiner*—Jim Goloboy
(74) *Attorney, Agent, or Firm*—Clark & Brody

(57) ABSTRACT

The present invention provides a lubricant composition for hot forming which makes it possible to provide lubricity at 80° C. or more without being peeled or washed by the roll cooling water, and which is easily washed under 40° C. without having water resistance. The lubricant composition for hot forming of the present invention comprises: a solid lubricant from 10 to 40% by mass; water-dispersible synthetic resin from 5 to 20% by mass; inorganic acid amine salt from 0.5 to 5% by mass; and water from 45 to 80% by mass.

8 Claims, 2 Drawing Sheets

FOREIGN PATENT DOCUMENTS

| | | |
|---|---|---|
| JP | 60-141796 | 7/1985 |
| JP | 62-034358 | 7/1987 |
| JP | 63-230796 | 9/1988 |
| JP | 63-230797 | 9/1988 |
| JP | 08-325584 | 12/1996 |
| JP | 2000-328082 | 11/2000 |

* cited by examiner

LUBRICANT COMPOSITION FOR HOT FORMING

TECHNICAL FIELD

The present invention relates to a lubricant composition for hot forming, which is specifically a lubricant for hot rolling of pipe or tube mainly used for the production of a seamless pipe or tube (hereinafter, refer to "pipe" as "pipe or tube") by means of a Mannesmann process.

BACKGROUND ART

In the production of a seamless metal pipe by means of a Mannesmann process, a billet or bloom heated is made into a hollow blank with use of piercing mill, and then the hollow blank is finished into a mother pipe by means of a continuance mill. When the hollow blank is rolled by the continuance mill, a mandrel bar is inserted into the heated hollow blank, then the hollow blank is continuously rolled by adjusting a gap of grooved rolls of the mill and the mandrel bar. At the step of elongation, various lubricants are used in order to reduce the friction and to prevent seizing between mandrel bar and the hollow blank.

In such hot forming under high temperature, lamellar solid lubricants such as graphite, boron nitride, and mica are usually used. Also, many proposals are provided that such lubricants are used to apply to tool in order to form a coating. According to these proposals, such lubricants provided are certainly water resistant, not peeled or washed by roll cooling water, and having almost no problem in lubricity.

However, lubricants which adhere to the spray booth, the neighboring equipments, and conveyor for transporting mandrel bar obtain water resistance when it is dried. When the dried lubricant is deposited, it is difficult to clean such areas, thus the dried lubricant worsens the working conditions. Further, lubricant deposited on equipments makes the maintenance operation of the equipments difficult; moreover it may result in malfunction and damage of such equipments.

In order to solve such inconvenience, for example, Patent Document 1 and Patent Document 2 propose lubricant compositions using water-soluble polymer. In addition, Patent Document 3 proposes lubricant composition which does not use polymer. These lubricant compositions are easily washed by water even after drying.

Patent Document 1: Japanese Patent Application Examined No. 62-34358

Patent Document 2: Japanese Patent Application No. 56-147297 (JP-A No. 58-047097)

Patent Document 3: Japanese Patent Application Laid-Open No. 8-325584

DISCLOSURE OF THE INVENTION

Problems to be Solved by the Invention

In seamless pipe plants in recent years, the design of the plants, compared with that in the past, is dramatically improved in consideration of working conditions and equipment conditions. However, lubricants which are used in such plants are still the above-mentioned conventional type of lubricants. In other words, a lubricant featuring lubricity has a water resistance against roll cooling water. Accordingly, this lubricant adheres to the spray booth, the neighboring equipments, and conveyor for transporting mandrel bar, which worsen the working condition. On the other hand, lubricants which are washable by water, disclosed in the Patent Documents 1 to 3, cannot provide originally required lubricity sufficiently, even when a lubricant are sprayed on the mandrel bar heated to high temperature 80° C. or more to form a dry-coating, it is easily peeled or washed by the roll cooling water. For this reason, seizing by the lack of lubricity, damage to the mandrel bar, and the like are caused. Further, friction coefficient becomes high and that makes it unable to produce pipes.

Accordingly, an object of the present invention is to provide a lubricant composition for hot forming, which stays at the lubricated area and provides good lubricity at high temperature 80° C. or more without being peeled or washed by the roll cooling water. On the other hand, it does not have water resistance at low temperature below 40° C., thus it is easily washed by water without depositing on the neighboring equipments.

Means for Solving the Problems

The present invention has a trade-off problem according to the technical common knowledge. Namely, when two liquid phases exist, normally, the two phases are easily mixed or solved each other at high temperature; if the temperature becomes lower, mixing and solving of the two phases each other becomes more difficult. The inventors of the present invention have found out that the above-mentioned trade-off problem can be solved by a lubricant which has mainly a solid lubricant workable in high temperature, and additionally has specific water-dispersible synthetic resin and inorganic acid amine salt. Such a lubricant makes it possible to improve the working conditions and to prevent malfunction of the equipments.

The first aspect of the present invention is a lubricant composition for hot forming comprising: solid lubricant from 10 to 40% by mass; water-dispersible synthetic resin from 5 to 20% by mass; inorganic acid amine salt from 0.5 to 5% by mass; and water from 45 to 80% by mass, for 100% by mass of the total mass of the lubricant composition. The water-dispersible synthetic resin is a vinyl acetate polymer obtained by emulsion polymerization using protective colloid selected from the group consisting of hydroxyethyl cellulose, sodium salt of carboxymethyl cellulose, and ammonium salt of carboxymethyl cellulose, or a vinyl acetate polymer obtained by emulsion polymerization using co-polymeric surfactant.

The second aspect of the present invention is a lubricant composition for hot forming comprising: solid lubricant from 15 to 30% by mass; water-dispersible synthetic resin from 5 to 15% by mass; inorganic acid amine salt from 0.5 to 3% by mass; and water from 47 to 77% by mass, for 100% by mass of the total mass of the lubricant composition. The water-dispersible synthetic resin is a vinyl acetate polymer obtained by emulsion polymerization using protective colloid selected from the group consisting of hydroxyethyl cellulose, sodium salt of carboxymethyl cellulose, and ammonium salt of carboxymethyl cellulose, or a vinyl acetate polymer obtained by emulsion polymerization using co-polymeric surfactant.

The third aspect of the present invention is a lubricant composition for hot forming comprising: solid lubricant from 10 to 40% by mass; water-dispersible synthetic resin from 5 to 20% by mass; inorganic acid amine salt from 0.5 to 5% by mass; and water from 45 to 80% by mass, for 100% by mass of the total mass of the lubricant composition. The water-dispersible synthetic resin is a resin obtained by polymerization with the following the first to the fourth ingredients, the first ingredient: main monomer from 85 to 99.7% by mass, the second ingredient: monomer having functioning group from 0.1 to 7% by mass, the third ingredient: cross-linking monomer from 0 to 5% by mass, and the fourth ingredient: co-polymeric surfactant from 2.1 to 7% by mass, for 100% by mass of the total mass of the first to the fourth ingredients, the main monomer is two or more monomers selected from methacrylic ester or acrylic ester, and solubility in the water to the main monomer is 1% or less.

The fourth aspect of the present invention is a lubricant composition for hot forming: comprising solid lubricant from 10 to 40% by mass; water-dispersible synthetic resin from 5 to 20% by mass; inorganic acid amine salt from 0.5 to 5% by mass; and water from 45 to 80% by mass, for 100% by mass of the total mass of the lubricant composition. The water-dispersible synthetic resin is a resin obtained by polymerization with the following the first to the fourth ingredients, the first ingredient: main monomer from 88 to 97.4% by mass, the second ingredient: monomer having functioning group from 0.2 to 5.5% by mass, the third ingredient: cross-linking monomer from 0 to 3% by mass, and the fourth ingredient: co-polymeric surfactant from 2.4 to 4.8% by mass, for 100% by mass of the total mass of the first to the fourth ingredients, the main monomer is two or more monomers selected from methacrylic ester or acrylic ester, and solubility in the water to the main monomer is 1% or less.

The functioning group of the monomer having functioning group is preferably selected from a group consisting of carboxyl group, epoxy group, amino group, and acetoacetyl group.

The co-polymeric surfactant is preferably an anionic system co-polymeric surfactant.

The ingredient of monomer, which constitutes the water-dispersible synthetic resin may further comprising the fifth ingredient: polymeric monomer having alkoxysilyl group from 0.01 to 2% by mass.

The amine salt of said inorganic acid is preferably a boric amine salt.

In a water resistance test, the above-mentioned lubricant composition for hot forming preferably being peeled below 15% of the total coating area at the temperature of 80° C., more preferably being peeled below 5% of the total coating area. Also, in water washability test, the lubricant composition for hot forming preferably being peeled 85% or more of the total coating area at the temperature of 40° C., more preferably being peeled 95% or more of the total coating area.

If a lubricant composition has water resistance at the temperature of 40° C. or less, the lubricant adhered to the equipments is dried under the normal room temperature in the plant, the dry-coating maintains the water resistance, therefore it is hard to be washed by washing water. If a lubricant composition does not have water resistance at the temperature of 80° C. or more, even though the lubricant applied to the mandrel bar heated up to 80° C. or more forms a dry-coating, it cannot maintain the water resistance. This causes peeling or washing out of the lubricant by roll cooling water, therefore the lubricant cannot maintain the originally required lubricity.

The wording "water resistance test" means a test evaluating coating/peeling situation of the coating, the test procedure is as follows. A test piece which is heated to the predetermined temperature and formed to the predetermined shape is coated by prepared lubricant composition for hot forming by spray-coating, until the coating amount becomes approximately 100 g/m$^2$. The coating on the test piece is dried for 5 minutes in the thermostatic bath. Then, as shown in FIG. 1, a test piece 11 is swung at the ratio of approximately one shuttle per second in such a way that the speed at the lowest point becomes 2 m/s, and is washed by water of the temperature between 20° C. and 25° C. coming from a fixed water spray nozzle 12 under the conditions of water pressure 0.2 MPa, flow rate 10 L/min, finally is made swung for 10 shuttles.

The wording "water washability test" means a test evaluating coating/peeling situation of the coating, the test procedure is as follows. A test piece which is heated to the predetermined temperature is coated by prepared lubricant composition for hot forming by spray-coating, until the coating amount becomes approximately 100 g/m$^2$. The coating on the test piece is dried for 24 hours under the room temperature. Then, as shown in FIG. 2, the surface of a test piece 21 coated by the lubricant composition is continuously washed for one minute by water (of between 20° C. and 25° C.) coming from a water spray nozzle 22 under the conditions of water pressure 0.2 MPa, flow rate 10 L/min.

The amount of coating is measured by the following procedure. A pre-test mass is measured with respect to each test piece by using precision balance, after the test, the pre-test mass is subtracted from a post-test mass of the test piece whose moisture is evaporated. Thus, the amount of coating can be measured.

The fifth aspect of the present invention is a method for producing seamless pipe or tube comprising the steps of: applying the above-mentioned lubricant composition for hot forming to a mandrel bar, and continuously rolling a pipe or tube by utilizing this mandrel bar.

EFFECTS OF THE INVENTION

As described above, according to the present invention, it is possible to provide a lubricant composition for hot forming, which is not peeled or washed by the roll cooling water at high temperature 80° C. or more, which does not have water resistance at low temperature below 40° C., and which is easily washed by water without depositing on the neighboring equipment.

DESCRIPTION OF THE REFERENCE NUMERALS

11, 21 test piece

12, 22 water spray nozzle

BEST MODE FOR CARRYING OUT THE INVENTION

Figure 1:
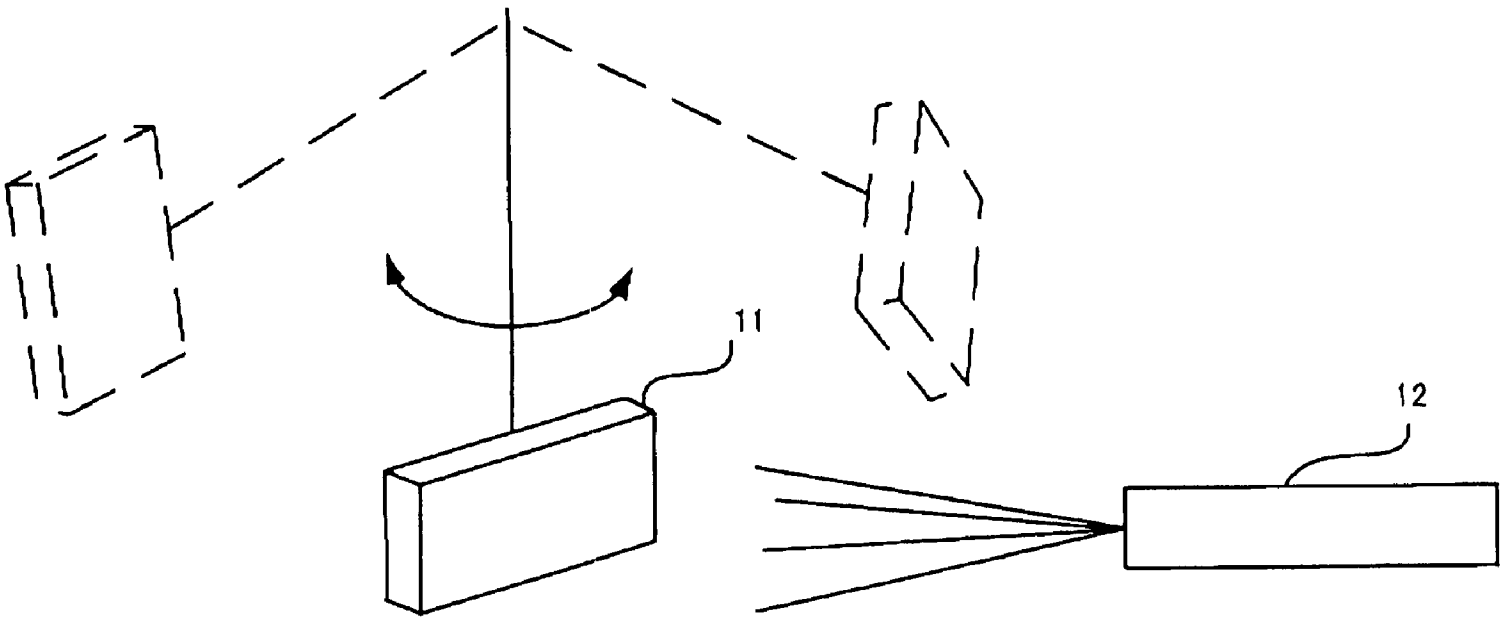
FIG. 1 A schematic view of the water resistance test.

Essential ingredients for producing a lubricant composition for hot forming of the present invention are solid lubricant, water-dispersible synthetic resin, and inorganic acid amine salt. Hereinafter, each of these ingredients is described respectively.

(1) Solid Lubricant

Solid lubricant is an essential ingredient for the present invention, lamellar compound, such as graphite, natural mica, artificial mica, boron nitride, bentonite, vermiculite, potassium tetrasilicone mica, and natural golden mica, can be used. Particle diameter of the solid lubricant, is not limited if it is within the sprayable range, preferably an average of 50 μm or less. Its purity is preferably 80% by mass or more, more preferably 90% by mass or more. On the basis of total mass of the lubricant composition, such solid lubricants contribute from 10 to 40% by mass. If the amount of solid lubricant is 10% by mass or more, sufficient lubricity can be obtained, thereby it is possible not to make seams on the inner surface of the product and not to damage the tool surface. Also, if the amount of solid lubricant is 40% by mass or less, the lubricant composition of the invention is excellent in sprayability, and is possible to provide sufficient amount of lubricant to the lubricating surface homogeneously. Thus, it is preferable.

(2) Water-dispersible Synthetic Resin

A water-dispersible synthetic resin exists as a micro solid portion in a lubricant composition for hot forming of the present invention. As a composition of the solid portion, for example, vinyl acetate resin and acrylic-based resin can be used. These may be used alone or in a form of co-polymer resin, such as a co-polymer of vinyl-acetate-based monomer and acrylic-based monomer. Further, for the purpose of improving water resistance after dry-coating of the lubricant, it is possible to mix stylene monomer. From the view point of water resistance at the state of dry-coating on the mandrel bar heated at 80° C. or more, the water-dispersible synthetic resin preferably contributes 5% by mass or more on the basis of total mass of the lubricant composition. Also, from the view point of realization of lubricity, environmental suitability, economic efficiency, the water-dispersible synthetic resin preferably contributes 20% by mass or less on the basis of total mass of the lubricant composition. In the invention, in combination with inorganic acid amine salt, there is a tendency to realize an effect of the lubricant composition forming a coating which is excellent in water resistance at 80° C. or more and is easily washed by water of below 40° C., and another effect of the lubricant composition which makes water resistance better after drying the coating. Consequently, vinyl acetate resin and acrylic-based resin polymerized by the specific methods are preferably used. Hereinafter, these resins are described.

<Vinyl Acetate Resin>

A vinyl acetate resin of the present invention is made into form a water-dispersible synthetic resin by emulsion polymerization using protective colloid and surfactant. The protective colloid used in the polymerization are substances which are generally used in the practice of the emulsion polymerization, such as polyvinyl alcohol. Particularly, hydroxyethyl cellulose, sodium salt of carboxymethyl cellulose, and ammonium salt of carboxymethyl cellulose are preferably used. These are particularly preferable in the view point of preventing gelatinization of protective colloid by the behavior of boric amine salt, when boric amine salt is used as inorganic amine salt. The surfactant used in the polymerization may be surfactants which are generally used in the practice of the emulsion polymerization. From the view point of water resistance, co-polymeric surfactant is preferably used. The wording "co-polymeric surfactant" means a compound which has polymeric groups that enable to co-polymerize with polymeric monomer, and which has functioning groups in the molecule so as to behave as surfactant.

As the co-polymeric surfactant, for example, sodium alkylallyl sulfosuccinate (registered trademark "ELEMINOL JS-2" available from SANYO CHEMICAL INDUSTRIES, LTD.), sodium polyoxypropylene methacryloyl sulfate (registered trademark "ELEMINOL RS-30" available from SANYO CHEMICAL INDUSTRIES, LTD.), polyoxyethylene nonylphenoxyallyloxy-propane sulfate salt (registered trademark "ADEKA REASOAP NE-10" available from ASAHI DENKA CO., LTD.), α-sulfo-ω-[2-(1-propenyl)-4-nonylphenoxy] polyoxyethylene ammonium salt (registered trademark "AQUALON HS-10" and "AQUALON HS-20" available from DAIICHI KOGYO CO., LTD.), α-hydro-ω-[2-(1-propenyl)-4-nonylphenoxy] polyoxyethylene (registered trademark "AQUALON RN-10", "AQUALON RN-20", and "AQUALON RN-50" available from DAIICHI KOGYO CO., LTD.), and alkylallyloxy hydroxypropyl sulfosuccinate salt (registered trademark "LATEMUL S-180A" available from KAO CORPORATION), can be used. In addition to this, ammonium polyoxyethylene alkylpropenyl phenylether sulfate, polyoxyethylene polybenzyl phenylether, polyoxyethylene alkylpropenyl phenylether, and the like can be used. Further, the above-mentioned protective colloid and co-polymeric surfactant may be used in combination with general surfactant.

<Acrylic-based Resin>

As the acrylic-based resin of the present invention, a resin which can be obtained by polymerization of under-mentioned from the first ingredient to the fourth ingredient, in some cases, together with the fifth ingredient, is preferably used.

The First Ingredient: Main Monomer

The wording "main monomer" of the present invention means two or more monomers selected from methacrylic ester or acrylic ester, the solubility of the combined monomers in the water is 1.0% by mass or less. The reason for setting the solubility in the water at 1.0% by mass or less is that the water resistant of the polymerized synthetic resin is largely caused by the solubility of the monomer in the water. Thus, a lubricant composition of the present invention obtained by polymerizing the main monomer having such solubility has a good performance.

Examples of main monomer include methacrylic ester and acrylic ester. The examples of methacrylic ester include ethyl methacrylate (solubility 0.99% by mass), n-butyl methacrylate (solubility 0.30% by mass), and cyclohexyl methacrylate (solubility 0.27% by mass). The example of acrylic ester includes ethyl acrylate (solubility 1.5% by mass), n-butyl acrylate (solubility 0.7% by mass), and 2-ethylhexylacrylate (solubility 0.14% by mass). In addition to these, combination of two or more main monomer can be used, if those solubilities to the water is 1.0% by mass or less. In the water-dispersible synthetic resin, content of main monomer is preferably set at 85% by mass from the view point of coating formability, more preferably 88% by mass or more, on the basis of total mass of from the first ingredient to the fourth ingredient (100% by mass). Further, from the view point of water resistant and adhesiveness, 99.7% by mass or less is preferable, 97.4% by mass or less is more preferable.

The Second Ingredient: Monomer Having Functioning Group

In the present invention, monomers having functioning group are added in order to improve the adhesiveness to the mandrel bar. As the monomers having functioning group of the invention, for example, monomers having carboxyl group such as acrylic acid and methacrylic acid; monomers having epoxy group such as grycidyl methacrylate; monomers having amino group such as diethylaminoethyl methacrylate; and monomers having acetoacetyl group such as allylacetate and acetoacetoxyethyl methacrylate, can be used. The content of monomers having functioning group in the water-dispersible synthetic resin is, from the view point of adhesiveness, 0.1% by mass or more is preferable, 0.2% by mass or more is more preferable, on the basis of total mass of from the first ingredient to the fourth ingredient (100% by mass). Further, from the view point of water resistant, 7% by mass or less is preferable, 5.5% by mass or less is more preferable.

The Third ingredient: Cross-linking Monomer

The cross-linking monomer is preferably mixed for the purpose of raising the strength of coating together with improving the water resistance. The cross-linking monomer of the present invention is a monomer having two or more polymerization active spots in the molecule. As the cross-linking monomers, for example, divinylbenzene, diallylphthalate, triallyl cyanurate, triallyl isocyanurate, tetraallyloxyethan, ethylene glycol diacrylate or methaacrylate, and the like can be used. When the coating strength is sufficient, it is not necessary to add these cross-linking monomers. However, from the view point of coating strength and water resistance, it is preferable to add a small amount of such cross-linking monomers. More specifically, in water-dispersible synthetic resin, the content of cross-linking monomer is preferably from 0 to 5% by mass, more preferably from 0 to 3% by mass, on the basis of total mass of from the first ingredient to the fourth ingredient (100% by mass).

The Fourth Ingredient: Co-polymeric Surfactant

The co-polymeric surfactant is the same co-polymeric surfactant which is used for the polymerization of the above-mentioned vinyl acetate resin and the examples thereof are also the same. If this co-polymeric surfactant is added, the water resistance at 80° C. or more can be in good condition. In the co-polymeric surfactant, particularly, anionic system co-polymeric surfactant is more preferable. These compounds may be used alone or in combination with thereof. In the water-dispersible synthetic resin, the content of co-polymeric surfactant is preferably from 2.1 to 7% by mass, more preferably from 2.4 to 4.8% by mass, on the basis of total mass of from the first ingredient to the fourth ingredient (100% by mass). The co-polymeric surfactant of the invention is a generally used co-polymeric surfactant, for example, anionic system surfactant such as sodium dialkyl sulfosuccinate, and sodium polyoxyethylene alkylphenylether sulfate, and non-ionic system surfactant such as polyoxyethylene alkylether can be used with a small amount thereof in the combined form.

The Fifth Ingredient: Polymeric Monomer Having Alkoxysilyl Group

In addition to from the first ingredient to the fourth ingredient constitute the above-mentioned acrylic resin, in the present invention, further, polymeric monomer having alkoxysilyl group can be used as the fifth ingredient constituting the above-mentioned acrylic resin. As polymeric monomer having alkoxysilyl group, for example, vinyltrimethoxysilane, vinyltriethoxysilane, vinyltris(β-methoxyethoxy)silane, γ-methacryloxypropyl trimethoxysilane, and the like can be used. The polymeric monomer having alkoxysilyl group is mixed for the purpose of cross-linking the particles (inter-particle cross-linking) after the water-dispersible resin being dried. Additive amount has to be specified such that polymerization must not be done when synthetic resin is dispersed in the water, and water resistant of the coating polymerized and dried at 40° C. or less must be minimized. Thus, The amount of usage of polymeric monomer having alkoxysilyl group is from 0.01 to 2% by mass, on the basis of total mass of monomer constituting acrylic resin of from the first ingredient to the fifth ingredient.

(3) Inorganic Acid Amine Salt

The inorganic acid amine salt is an essential ingredient so as to make the washing of coating of water-dispersible synthetic resin easier at 40° C. or less. Although the synthetic resin used in the present invention alone has a certain extent of washability, in order to obtain a sufficient washing effect, high pressure water-jet is needed for a long time. Therefore, in order to realize an easier washing for a lubricant composition for hot forming, inorganic acid amine salt is added. In the invention, as inorganic acid amine salt, it is not limited if it is water-soluble. As inorganic acid, for example, boric acid, molybdenum acid, tungsten acid, and the like can be used. Especially, boric acid provides an excellent effect, therefore it is preferably used. As amine, for example, monoethanolamine, diethanolamine, triethanolamine, monoisopropanolamine, ethylmonoethanolamine, dimethylethanolamine, and the like can be used. The mixing amount of inorganic acid amine salt is, from the view point of water washability, preferably 0.5% by mass or more, and more preferably 1% by mass, on the basis of total mass of lubricant composition (100% by mass). Further, from the view point of prevention of deterioration in water resistant at high temperature, 5% by mass or less is preferable, and 3% by mass or less is furthermore preferable.

(4) Other Ingredients

In order to adjust the dry-coating, it is permissible to suitably select glycol such as ethylene glycol butylether, 1,2,4-trimethylpentadiol 1,3-monoisobutylate and to add thereof, as long as it does not prevent water resistance of the coating. In addition, thickener to adjust the viscosity of a lubricant composition for hot forming of the present invention, anti-foaming agent for controlling the foaming, antiseptic agent for preventing decay, disinfection agent, moistening agent for dispersing solid lubricants, and dispersing agent, can be suitably mixed.

In the lubricant composition for hot forming of the present invention, the above-mentioned solid lubricants, water-dispersible synthetic resin, inorganic acid amine salt, and the like are dispersed or dissolved in the water. This lubricant composition is produced by the following method. The above-mentioned water-soluble synthetic resin is produced by emulsion polymerization. Into the aqueous solution containing the obtained water-soluble synthetic resin, solid lubricants, inorganic acid amine salt, and the like may be added. Or, the water-soluble synthetic resin may be isolated, and then, solid lubricant, inorganic acid amine, and the like may be added thereto, further water may be added thereto, so as to adjust the lubricant composition for hot forming.

EXAMPLES

Hereinafter, the invention will be more specifically described by way of the following examples.

<Adjustment of Water-dispersible Synthetic Resin>

Production Examples 1 to 4

To the reactor, 60 parts by mass of ion-exchanged water and surfactant shown in Table 1 were added. While stirring this mixed solution, 4.5 parts by mass of vinyl acetate, and 0.05 parts by mass of ammonium persulfate as a polymerization initiator were added thereto, then the resultant was heated in the atmosphere of nitrogen, and the heated resultant was pre-polymerized between 80° C. and 90° C. for from 0.5 to 1.0 hour in the same position.

After that, 40.5 parts by mass of vinyl acetate and 0.1 parts by mass of ammonium persulfate were continuously delivered by drops into the mixed solution for from 3 to 6 hours, further polymerization was carried out between 80° C. and 90° C. for from 1 to 1.5 hours in the same position. From this procedure, an aqueous solution containing water-soluble synthetic resin was obtained.

Production Examples 5 to 13

30 parts by mass of ion-exchanged water, 45 parts by mass in total of monomer ingredients shown in Table 2, and mixture of surfactant shown in Table 2 were stirred and monomeric emulsion for polymerization was obtained.

To the reactor, 30 parts by mass of ion-exchanged water, 10 parts by mass of the above-mentioned monomeric emulsion for polymerization, 0.03 parts by mass of ammonium persulfate as a polymerization initiator were added, then the resultant was stirred and heated in the atmosphere of nitrogen, and the heated resultant was kept in the condition between 70° C. and 80° C. for 0.5 hour so as to be polymerized.

After that, 90 parts by mass of the above-mentioned monomeric emulsion for polymerization and 0.1 parts by mass of ammonium persulfate were continuously delivered by drops into this polymerized solution for from 3 to 6 hours, further polymerization was carried out in the condition kept between 70° C. and 80° C. for from 1 to 1.5 hours. The obtained polymerized solution was neutralized by ammonia water, as need arises. From this procedure, an aqueous solution containing water-soluble synthetic resin was obtained.

TABLE 1

| Water-dispersible synthetic resin | Production Example 1 | Production Example 2 | Production Example 3 | Production Example 4 |
|---|---|---|---|---|
| Vinyl acetate | 95.0 | 94.0 | 92.0 | 95.0 |
| Hydroxyethyl cellulose | 5.0 | — | — | 2.0 |
| Sodium salt of carboxymethyl cellulose | — | 6.0 | — | — |
| Ammonia salt of carboxymethyl cellulose | — | — | 8.0 | — |
| Co-polymeric surfactant 3 | — | — | — | 3.0 |

In Tables 1 and 2, co-polymeric surfactant 1 means sodium alkylallyl sulfosuccinate (registered trademark: "ELEMINOL JS-2", produced by SANYO CHEMICAL INDUSTRIES, LTD.). Co-polymeric surfactant 2 means ammonium polyoxyethylene alkylphenylethersulfate (registered trademark: "AQUALON HS-20", produced by DAIICHI KOGYO CO., LTD.). Co-polymeric surfactant 3 means α-sulfo-ω-(1-(nonylphenoxy)methyl-2-(2-propenyloxy)ethoxy poly(oxy-1,2-ethandiyl ammonium salt (registered trademark: "ADEKA REASOAP SE10N", produced by ASAHI DENKA CO., LTD.). The wording "general surfactant" means polyoxyalkylene alkylethersulfate (registered trademark: "NEW COLE 707-SF", produced by NIPPON NYUKAZAI CO., LTD.).

Examples 1 to 16

Aqueous solution containing water-dispersible synthetic resin whose types and amount are shown in Tables 3 and 4, and water containing thickener and dispersing agent were mixed, then a mixed solution whose solid portion concentration was adjusted was obtained. Thereto, predetermined amount of solid lubricant (graphite, boron nitride, potassium tetrasilicone mica, natural golden mica), inorganic acid amine salt (boric monoethanol amine salt, tungsten acid monoethanol amine salt), and other ingredients (antiseptic agent, antifoarming agent) were added, thus lubricant compositions for hot forming were obtained. The obtained lubricant compositions for hot forming were evaluated in accordance with the following evaluation method. The results are shown in Table 7.

TABLE 2

| Water-dispersible synthetic resin | Production Example 5 | Production Example 6 | Production Example 7 | Production Example 8 | Production Example 9 | Production Example 10 | Production Example 11 | Production Example 12 | Production Example 13 |
|---|---|---|---|---|---|---|---|---|---|
| MMA | 64.6 | 63.0 | — | 50.0 | 43.0 | 41.3 | 68.2 | 82.0 | 35.0 |
| CHMA | — | — | 70.0 | | — | 30.3 | — | — | — |
| n-BMA | — | 15.0 | — | 20.0 | 25.0 | — | — | — | — |
| EA | — | — | — | — | — | — | — | — | 55.0 |
| BA | 27.4 | — | 8.0 | 23.0 | 10.0 | 10.3 | — | — | — |
| 2EHA | — | 15.0 | 10.0 | — | 10.0 | 15.5 | 28.3 | 5.0 | — |
| Acrylic acid | 2.0 | 1.5 | 1.5 | 2.0 | 3.0 | 0.2 | 0.2 | 2.0 | 2.5 |
| Grycidyl methacrylate | — | 1.5 | — | 1.0 | 1.0 | — | — | — | 1.5 |
| Acetoacetoxyethyl acrylate | — | — | 4.0 | — | — | — | — | — | 1.0 |
| Vinyl trimethoxysilane | 1.0 | — | 1.0 | — | — | — | — | — | 1.0 |
| γ-methacryloxypropyl trimethoxysilane | — | 0.2 | 0.2 | 0.1 | 0.2 | — | — | — | — |
| Divinyl benzen | 1.0 | — | 2.0 | 0.5 | 2.0 | — | — | 5.0 | 2.0 |
| Diallyl phthalate | — | 1.0 | — | — | 1.0 | — | — | 3.0 | — |
| Co-polymeric surfactant 1 | 4.0 | — | — | — | — | — | — | — | — |
| Co-polymeric surfactant 2 | — | — | 3.3 | 2.9 | — | — | 3.3 | — | 2.0 |
| Co-polymeric surfactant 3 | — | 2.8 | — | — | 4.8 | 2.4 | — | — | — |
| General surfactant | — | — | — | 0.5 | — | — | — | 3.0 | — |

MMA: methyl methacrylate

CHMA: cyclohexyl methacrylate n-BMA: n-butyl methacrylate

EA: ethyl acrylate

BA: butyl acrylate

TABLE 3

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Production Example 1 | 7.50 | 10.00 | — | — | — | — | — | — | — | — |
| Production Example 2 | — | — | 15.00 | — | — | — | — | — | — | — |
| Production Example 3 | — | — | — | 6.00 | — | — | — | — | — | — |
| Production Example 4 | — | — | — | — | 10.00 | — | — | — | — | — |
| Production Example 5 | — | — | — | — | — | 10.00 | — | — | 7.50 | — |
| Production Example 6 | — | — | — | — | — | — | 18.00 | — | — | — |
| Production Example 7 | — | — | — | — | — | — | — | 5.00 | — | — |
| Production Example 8 | — | — | — | — | — | — | — | — | — | 8.00 |
| Production Example 9 | — | — | — | — | — | — | — | — | — | — |
| Amine monoethanoltungstate | 2.00 | — | — | — | — | — | — | — | 2.00 | — |
| Monoethanolamine borate | — | 1.50 | 2.50 | 0.50 | 2.00 | 1.00 | 3.00 | 0.50 | — | 1.50 |
| Graphite | 25.00 | 25.00 | 15.00 | 15.00 | 20.0 | 30.00 | 30.00 | 20.00 | 25.00 | 25.00 |
| Thickener | 0.80 | 0.80 | 1.00 | 1.50 | 1.00 | 1.00 | 1.00 | 1.50 | 1.00 | 0.80 |
| Antiseptic agent | 0.10 | 0.10 | 0.10 | 0.10 | 0.10 | — | 0.10 | 0.10 | — | 0.10 |
| Antifoaming agent | 0.01 | 0.01 | 0.01 | 0.01 | 0.01 | — | — | 0.01 | — | 0.01 |
| Dispersing agent | 0.50 | 0.50 | 0.50 | 0.50 | 0.50 | 1.00 | 0.50 | 0.50 | 1.00 | 1.00 |
| Water | 64.09 | 62.09 | 65.89 | 76.39 | 66.39 | 57.00 | 47.40 | 72.39 | 63.50 | 63.59 |

TABLE 4

| | Example 11 | Example 12 | Example 13 | Example 14 | Example 15 | Example 16 |
|---|---|---|---|---|---|---|
| Production Example 5 | 7.00 | — | — | — | — | — |
| Production Example 6 | — | 15.00 | — | — | — | — |
| Production Example 7 | — | | 10.00 | — | — | — |
| Production Example 9 | — | | — | 15.00 | — | — |
| Production Example 10 | | | | | 8.00 | |
| Production Example 11 | — | | — | — | — | 12.00 |
| Monoethanolamine borate | 1.00 | 2.00 | 1.50 | 1.50 | 1.50 | 1.00 |
| Graphite | 10.00 | 25.00 | — | 25.00 | 15.00 | 25.00 |
| Boron nitride | 5.0 | — | — | — | — | — |
| Potassium tetrasilicone mica | — | — | 20.00 | — | — | — |
| Natural golden mica | — | — | — | — | 5.00 | — |
| Thickener | 1.50 | 1.0 | 1.00 | 1.00 | 1.00 | 1.00 |
| Antiseptic agent | 0.10 | 0.10 | 0.10 | 0.10 | 0.10 | 0.10 |
| Antifoaming agent | 0.01 | 0.01 | 0.01 | 0.01 | 0.01 | 0.01 |
| Dispersing agent | 1.00 | 1.00 | 1.00 | 1.00 | 1.00 | 1.00 |
| Water | 74.39 | 55.89 | 66.39 | 56.39 | 68.39 | 59.89 |

Comparative Examples 1 to 6

A mixed solution, which solid portion concentration was adjusted, was obtained by mixing aqueous solution containing water-dispersible synthetic resin whose types and amount are shown in Table 5, and water containing thickener and dispersing agent. Thereto, predetermined amount of solid lubricant (graphite, boron nitride, fluoro golden mica), inorganic acid amine salt (boric monoethanol amine salt), and other ingredients (antiseptic agent, antifoarming agent) were added, thus lubricant compositions for hot forming were obtained. The obtained lubricant compositions for hot forming were evaluated in accordance with the following evaluation method. The results are shown in Table 7.

TABLE 5

| | Comparative Example 1 | Comparative Example 2 | Comparative Example 3 | Comparative Example 4 | Comparative Example 5 | Comparative Example 6 |
|---|---|---|---|---|---|---|
| Production Example 5 | 10.00 | — | — | — | — | 25.00 |
| Production Example 7 | — | 25.00 | — | — | — | — |
| Production Example 8 | — | — | 10.00 | — | — | — |
| Production Example 10 | — | — | — | 4.00 | 5.00 | — |
| Monoethanolamine borate | 0.2 | 6.0 | | 1.0 | 2.0 | 10.0 |
| Graphite | 50.00 | 20.00 | 25.00 | 8.00 | 45.00 | 5.00 |
| Boron nitride | — | — | — | — | — | — |
| Fluoro golden mica | — | — | — | — | — | — |
| Thickener | 0.50 | 1.00 | 1.00 | 2.00 | 0.50 | 0.50 |
| Antiseptic agent | 0.10 | 0.10 | 0.10 | 0.10 | 0.10 | 0.10 |
| Antifoaming agent | 0.01 | 0.01 | 0.01 | 0.01 | 0.01 | 0.01 |
| Dispersing agent | 1.00 | 1.00 | 1.00 | 1.00 | 1.00 | 1.00 |
| Water | 38.19 | 46.89 | 62.89 | 83.89 | 46.39 | 58.39 |

Comparative Examples 7 to 12

As water-dispersible synthetic resin,

Commercial item (1): vinyl acetate polymer (registered trademark: "MOWINYL 50M", produced by CLARIANT (JAPAN) K.K.), Commercial item (2): acrylates co-polymer (registered trademark: "ARON A104", produced by TOAGOSEI CO., LTD.), Commercial item (3): polyethylene glycol (registered trademark: "PEG10000", produced by DAIICHI KOGYO CO., LTD.), and water-dispersible synthetic resin obtained by the Production examples 12 and 13 were selected, each of which was used to obtain lubricant compositions for hot forming. To each water-dispersible resin listed above, predetermined amount of each ingredient other than the above water-dispersible resins shown in Table 6 was added. The obtained lubricant compositions for hot forming were evaluated in accordance with the following evaluation method. The results are shown in Table 7.

TABLE 6

| | Comparative Example 7 | Comparative Example 8 | Comparative Example 9 | Comparative Example 10 | Comparative Example 11 | Comparative Example 12 |
|---|---|---|---|---|---|---|
| Commercial item (1) | 10.00 | — | — | — | — | — |
| Commercial item (2) | — | 15.00 | — | — | — | — |
| Commercial item (3) | — | — | 20.00 | — | — | — |
| Production Example 12 | — | — | — | 10.00 | — | — |
| Production Example 13 | — | — | | — | 8.00 | 8.00 |
| Graphite | 25.00 | 20.00 | 20.00 | 25.00 | 25.00 | 15.00 |
| Monoethanolamine borate | 2.00 | — | — | — | — | 2.0 |
| Boron nitride | — | — | 5.00 | — | — | — |
| Fluoro golden mica | — | — | — | — | — | 5.00 |
| Thickener | 1.00 | 1.00 | 1.00 | 1.00 | 1.00 | 1.00 |
| Antiseptic agent | 0.10 | 0.10 | 0.10 | 0.10 | 0.10 | 0.10 |
| Antifoaming agent | 0.01 | 0.01 | 0.01 | 0.01 | 0.01 | 0.01 |
| Dispersing agent | 1.00 | 1.00 | 1.00 | 1.00 | 1.00 | 1.00 |
| Water | 60.89 | 62.89 | 52.89 | 62.89 | 64.89 | 67.89 |

<Evaluation Method>

(1) Water Resistance

A metallic test piece heated at 80° C. was coated by the obtained lubricant composition for hot forming by spray-coating, until the coating amount becomes approximately 100 g/m$^2$. The coating on the test piece was dried for 5 minutes under the room temperature. Then, as shown in FIG. 1, a test piece 11 was swung at the ratio of approximately one shuttle per second in such a way that the speed at the lowest point becomes 2 m/s, and was continuously washed by water (of between 20° C. and 25° C.) coming from a fixed water spray nozzle 12 under the conditions of water pressure 0.2 MPa, flow rate 10 L/min, finally made it swung for 10 shuttles. The peeling condition of the coating was evaluated based on the following criteria.

◎: The coat was not peeled.

○: The coat was slightly peeled (the peeled part was under 15% of the total coating area).

Δ: The coat was peeled at the ratio of 15% or more, under 80% of the total coating area.

x : Almost all coating was peeled (80% or more part of the total coating area was peeled).

(2) Water Washability

Figure 2:
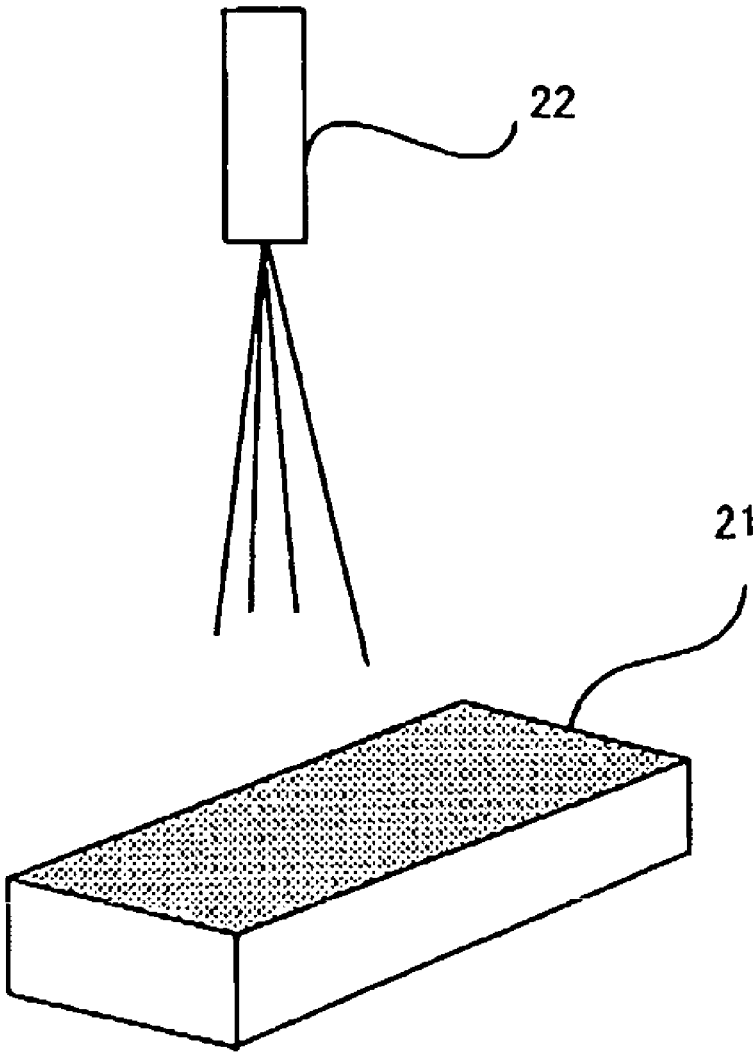
FIG. 2 A schematic view of the water washability test.

A metallic test piece heated at 40° C. was coated by the obtained lubricant composition for hot forming by spray-coating, until the coating amount becomes approximately 100 g/m$^2$. The coating on the test piece was dried for 24 hours under the room temperature. Then, as shown in FIG. 2, the surface of a test piece 21 coated by the lubricant composition was continuously washed for one minute by water (of between 20° C. and 25° C.) coming from a water spray nozzle 22 under the conditions of water pressure 0.2 MPa, flow rate 10 L/min. The washing condition of the coating was evaluated based on the following criteria.

◎: Almost all coating was peeled (80% or more part of the total coating area was peeled).

○: The coat was peeled at the ratio of 15% or more, under 80% of the total coating area.

Δ: The coat was slightly peeled (the peeled part was under 15% of the total coating area).

x : The coat was not peeled.

(3) Lubricity

Friction coefficient was determined by Ring Compression Test, and the lubricity was evaluated based on the following criteria. In this case, "Ring Compression Test" is a method for determining friction coefficient to use the behavior of ring-shaped test piece, which is firstly compressed between tools being positioned parallel, then made into different shapes depending on the condition of friction.

◎: The friction coefficient was under 0.06.

○: The friction coefficient was 0.06 or more, under 0.08.

Δ: The friction coefficient was 0.08 or more, under 0.10.

x : The friction coefficient was 0.01 or more.

<Evaluation Result>

TABLE 7

| | Water resistance, Water detergent property | | | |
|---|---|---|---|---|
| | 40° C. | 80° C. | Lubricity | Notes |
| Example 1 | ○ | ○ | ◎ | |
| Example 2 | ○ | ◎ | ◎ | |
| Example 3 | ○ | ◎ | ◎ | |
| Example 4 | ○ | ◎ | ◎ | |
| Example 5 | ○ | ◎ | ◎ | |
| Example 6 | ◎ | ◎ | ◎ | |
| Example 7 | ◎ | ◎ | ◎ | |
| Example 8 | ◎ | ◎ | ◎ | |
| Example 9 | ◎ | ◎ | ◎ | |
| Example 10 | ○ | ◎ | ◎ | |
| Example 11 | ◎ | ◎ | ◎ | |

TABLE 7-continued

| | Water resistance, Water detergent property | | | |
|---|---|---|---|---|
| | 40° C. | 80° C. | Lubricity | Notes |
| Example 12 | ◎ | ◎ | ◎ | |
| Example 13 | ◎ | ◎ | Δ | |
| Example 14 | ○ | ◎ | ◎ | |
| Example 15 | ◎ | ◎ | ○ | |
| Example 16 | ○ | ◎ | ◎ | |
| Comparative Example 1 | — | — | — | non-sprayable |
| Comparative Example 2 | | ◎ | ◎ | |
| Comparative Example 3 | | ◎ | ◎ | |
| Comparative Example 4 | ◎ | | ○ | poor in adhesiveness |
| Comparative Example 5 | — | — | — | non-sprayable |
| Comparative Example 6 | ◎ | | | |
| Comparative Example 7 | — | — | — | gelatinized |
| Comparative Example 8 | | ◎ | ◎ | |
| Comparative Example 9 | ◎ | | ○ | |
| Comparative Example 10 | ○ | | ◎ | |
| Comparative Example 11 | | | ◎ | |
| Comparative Example 12 | ○ | | ○ | |

Evaluation Test by Actual Machine>

A mandrel mill composed of 5 stands was used. For the test, element pipe having a size of diameter 330 mm, thickness from 27.0 to 29.9 mm, and length from 9000 to 11500 mm was used. The pipe at the exit side of mandrel mill was in size of outer diameter 276 mm and thickness from 12.0 to 14.0 mm. The material of element pipe was carbon steel. The mandrel bar having a size of diameter 250 mm was used. Further, the temperature of element pipe was set between 150° C. and 1150° C. On the other hand, the temperature of mandrel bar was set at 80° C.

As lubricant compositions, three types thereof defined as Example 5, Comparative examples 3 and 6 were used. Coating method of lubricant composition was spray-coating. 5000 pipes were rolled by 5 mandrel bars (in other words, 1000 pipes were rolled per mandrel bar) After rolling, number of damaged mandrel bars and seams on the inner surface of the pipes were evaluated.

TABLE 8

| Lubricant | Number of damaged bars | Number of seams developed on the inner surface (%) | Working conditions |
|---|---|---|---|
| Example 5 | 0 | 0 (0.0%) | Not worsened as water washing was available. |
| Comparative Example 3 | 0 | 0 (0.0%) | Worsened as water washing was impossible. |
| Comparative Example 6 | 2 | 150 (1.5%) | Not worsened as water washing was available. |

CONCLUSION

Comparative example 3 was excellent in lubricity with the effect of improving adhesiveness, and it did not cause any damages to mandrel bars nor seams on the inner surface of the pipes. However, Comparative example 3 was not water-washable, therefore the remained lubricants worsened the working conditions. On the other hand, Comparative example 6 was water-washable, and therefore working conditions was good. Nevertheless, it did not have adhesiveness to the lubricated area as a lubricant, consequently it damaged mandrel bars and caused seams on the inner surface of the pipes.

The lubricant composition defined as Example 5 had water resistance at 80° C. or more, no damage to mandrel bars nor seams on the inner surface of the pipes were found. Furthermore, it was water-washable and was not adhesive at 40° C. or less, the working conditions was not worsened.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that a lubricant composition for hot forming with such an alternation are included in the technical scope of the invention.

The invention claimed is:

1. A lubricant composition for hot forming comprising: a solid lubricant from 10 to 40% by mass; a water-dispersible synthetic resin from 5 to 20% by mass; an inorganic acid amine salt from 0.5 to 5% by mass; and water from 45 to 80% by mass, for 100% by mass of the total mass of the lubricant composition, wherein said water-dispersible synthetic resin is a vinyl acetate polymer obtained by emulsion polymerization using protective colloid selected from a group consisting of hydroxyethyl cellulose, sodium salt of carboxymethyl cellulose, and ammonium salt of carboxymethyl cellulose, or a vinyl acetate polymer obtained by emulsion polymerization using co-polymeric surfactant, and the inorganic acid of said inorganic acid amine salt is selected from boric acid, molybdenum acid or tungsten acid.

2. A lubricant composition for hot forming comprising: solid lubricant from 15 to 30% by mass; water-dispersible synthetic resin from 5 to 15% by mass; inorganic acid amine salt from 0.5 to 3% by mass; and water from 47 to 77% by mass, for 100% by mass of the total mass of the lubricant composition, wherein said water-dispersible synthetic resin is a vinyl acetate polymer obtained by emulsion polymerization using protective colloid selected from a group consisting of hydroxyethyl cellulose, sodium salt of carboxymethyl cellulose, and ammonium salt of carboxymethyl cellulose, or a vinyl acetate polymer obtained by emulsion polymerization using co-polymeric surfactant, and the inorganic acid of said inorganic acid amine salt is selected from boric acid, molybdenum acid or tungsten acid.

3. A lubricant composition for hot forming according to claim 1, wherein the amine salt of said inorganic acid is a boric amine salt.

4. A lubricant composition for hot forming according to claim 1, in a water resistance test, peeling below 15% is shown at the temperature of 80° C., and in water washability test, peeling of 85% or more is shown at the temperature of 40° C.

5. A method for producing seamless pipe or tube comprising the steps of: applying of the lubricant composition for hot forming as claimed in claim 1 to a mandrel bar, and continuously rolling a pipe or tube by utilizing this mandrel bar.

6. A lubricant composition for hot forming according to claim 2, wherein the amine salt of said inorganic acid is a boric amine salt.

7. A lubricant composition for hot forming according to claim 2, in a water resistance test, peeling below 15% is shown at the temperature of 80° C., and in water washability test, peeling of 85% or more is shown at the temperature of 40° C.

8. A method for producing seamless pipe or tube comprising the steps of: applying of the lubricant composition for hot forming as claimed in claim 2 to a mandrel bar, and continuously rolling a pipe or tube by utilizing this mandrel bar.

* * * * *